US007601102B2

(12) United States Patent
Alessandri et al.

(10) Patent No.: US 7,601,102 B2
(45) Date of Patent: Oct. 13, 2009

(54) GYMNASTIC MACHINE

(75) Inventors: Nerio Alessandri, Longiano (IT); Francesco Della Vittoria, Cesena (IT); Gianmatteo Fabbri, Rimini (IT); Fabio Ferretti, Livorno (IT)

(73) Assignee: Technogym S.p.A., Gambettola (FC) (IT)

( * ) Notice: Subject to any disclaimer, the term of this patent is extended or adjusted under 35 U.S.C. 154(b) by 0 days.

(21) Appl. No.: 11/986,425

(22) Filed: Nov. 21, 2007

(65) Prior Publication Data

US 2008/0132385 A1 Jun. 5, 2008

(30) Foreign Application Priority Data

Nov. 24, 2006 (IT) ..... RA2006A000072

(51) Int. Cl.
*A63B 22/04* (2006.01)

(52) U.S. Cl. ..... 482/52; 482/62; 482/71

(58) Field of Classification Search ..... 482/51, 482/52, 62, 66, 71, 79
See application file for complete search history.

(56) References Cited

U.S. PATENT DOCUMENTS

| | | | | |
|---|---|---|---|---|
| 4,781,372 | A * | 11/1988 | McCormack | 482/70 |
| 4,811,941 | A * | 3/1989 | Elo | 482/51 |
| 4,869,496 | A * | 9/1989 | Colombo | 482/71 |
| 4,915,373 | A * | 4/1990 | Walker | 482/51 |
| 5,692,995 | A * | 12/1997 | Alvarez et al. | 482/71 |
| 5,911,650 | A * | 6/1999 | Cox | 482/70 |
| 6,231,484 | B1 * | 5/2001 | Gordon | 482/71 |
| 6,238,321 | B1 * | 5/2001 | Arnold et al. | 482/52 |
| 6,277,055 | B1 * | 8/2001 | Birrell et al. | 482/52 |
| 6,849,032 | B2 * | 2/2005 | Chu | 482/51 |
| 7,115,073 | B2 * | 10/2006 | Nizamuddin | 482/51 |
| 7,244,217 | B2 * | 7/2007 | Rodgers, Jr. | 482/52 |
| 7,303,509 | B2 * | 12/2007 | Schroder | 482/52 |
| 7,338,414 | B1 * | 3/2008 | Hsiung | 482/71 |
| 7,402,126 | B2 * | 7/2008 | Chang | 482/52 |
| 2005/0245357 | A1 * | 11/2005 | Horvath | 482/51 |
| 2006/0293153 | A1 * | 12/2006 | Porth et al. | 482/52 |
| 2007/0042871 | A1 * | 2/2007 | Wu et al. | 482/52 |
| 2007/0238582 | A1 * | 10/2007 | Lee | 482/52 |

FOREIGN PATENT DOCUMENTS

EP 1598095 A2 * 11/2005

* cited by examiner

*Primary Examiner*—Fenn C Mathew
*Assistant Examiner*—Andrew M Tecco
(74) *Attorney, Agent, or Firm*—Abelman, Frayne & Schwab

(57) ABSTRACT

Gymnastic machine (1) for simulating the skating movement provided with a frame (10) carrying a load unit (20), with an exercise station (30) for performing a training exercise, and with a first functional group (31) and a second functional group: the first group (31) being mechanically connected to the load unit (20) in order to exchange mechanical energy with this latter; the first group (31) comprising at least a footrest (33) carried in a rotatable manner and in open chain by the frame (10); the second functional group (60) comprising at least a third lever (61); transmission means (70) being positioned between the first and second functional groups (31)(60) in order to connect each third lever (61) to a respective footrest (33) for performing a training exercise for training the upper limbs in combination with a simulation of the skating movement.

22 Claims, 4 Drawing Sheets

GYMNASTIC MACHINE

The present invention relates to a gymnastic machine. In particular, the present invention relates to a gymnastic machine effectively usable for simulating the skating movement.

BACKGROUND OF THE INVENTION

In the field of gymnastic machines for cardiovascular training there are well-known gymnastic machines provided with a load group comprising a regulating unit of an electromagnetic nature. Among these machines stationary bikes, treadmills, steppers and so-called cross trainers, i.e. machines provided with footrests movable along elliptic trajectories, are well-known. In the case of the treadmills, the performed exercise directly involves also the use of the arms, which generally perform an oscillating movement in a substantially vertical plane, wherein the forearms swing forward and backward accompanying the movement of the lower limbs. In the other cases, movement of the arms may or may not be provided for but, in any case, for instance in stationary bikes and cross trainers, this movement can take place against the resistance of a load group, for example through the installation of a pair of levers pivoted to the frame, each of which is provided with a handgrip, is connected to the load group by means of a plurality of cylindrical turning pairs, and is movable along a plane that is vertical and thus parallel to the plane on which the pedals move. A solution of this kind is described in the U.S. Pat. No. 6,752,744 by the American firm Precor, but can be verified by observing the machine called "Cross Trainer" of the American firm Ultratrek.

Naturally, the use of the arms in association with the use of the lower limbs allows training to be made collectively more efficient from the muscular point of view and allows better distribution of muscle strain between the upper part and the lower part of the body, thus allowing a noteworthy increase in the percentage of exercises completed according to the provided exercise tables even in conditions of fatigue of one of the two articular regions, given that the part suffering the most from fatigue can be helped by the part with more muscular power.

The movement that can be provided on the simulators is a curvilinear movement in space, whose radius of curvature changes when there is a variation of each angular position of the lever carrying the respective footrest; therefore, cardiovascular training of the so-called "total body" type cannot be achieved by modifying the skating simulators similarly to what is known for stationary bikes, steppers and cross trainers, due to the fact that the types of trajectories are completely different.

In view of the above description, the problem of allowing, in a simple manner and with limited costs, performance of a movement of the upper limbs against the resistance of a single load group in skating simulators is currently unsolved and represents an interesting challenge for the applicant, in order to facilitate performance of the exercises and to make these more complete from the point of view of muscular development. In view of the above description, it would be desirable to have available a gymnastic machine for simulating the skating movement which, in addition to enabling to limit and possibly to overcome the typical drawbacks of the art illustrated above in a simple and cost-effective manner, could define a new standard for training with combined movements of the parts.

SUMMARY OF THE PRESENT INVENTION

The present invention relates to a gymnastic machine. In particular, the present invention relates to a gymnastic machine effectively usable for simulating the skating movement.

The object of the present invention is to provide a gymnastic machine that allows the disadvantages described above to be solved, and which is suitable to satisfy a plurality of requirements that to date have still not been addressed, and therefore, suitable to represent a new and original source of economic interest and capable of modifying the current market of gymnastic implements for gymnasiums or for home use.

According to the present invention, a gymnastic machine is provided, whose main characteristics are described in at least one of the appended claims.

BRIEF DESCRIPTION OF THE DRAWINGS

Further characteristics and advantages of the gymnastic machine according to the present invention will be more apparent from the description below, set forth with reference to the accompanying drawings, which illustrate at least one non-limiting example of embodiment, in which identical or corresponding parts of the device are identified by the same reference numbers. In particular.

DETAILED DESCRIPTION OF THE PRESENT INVENTION

Figure 1:
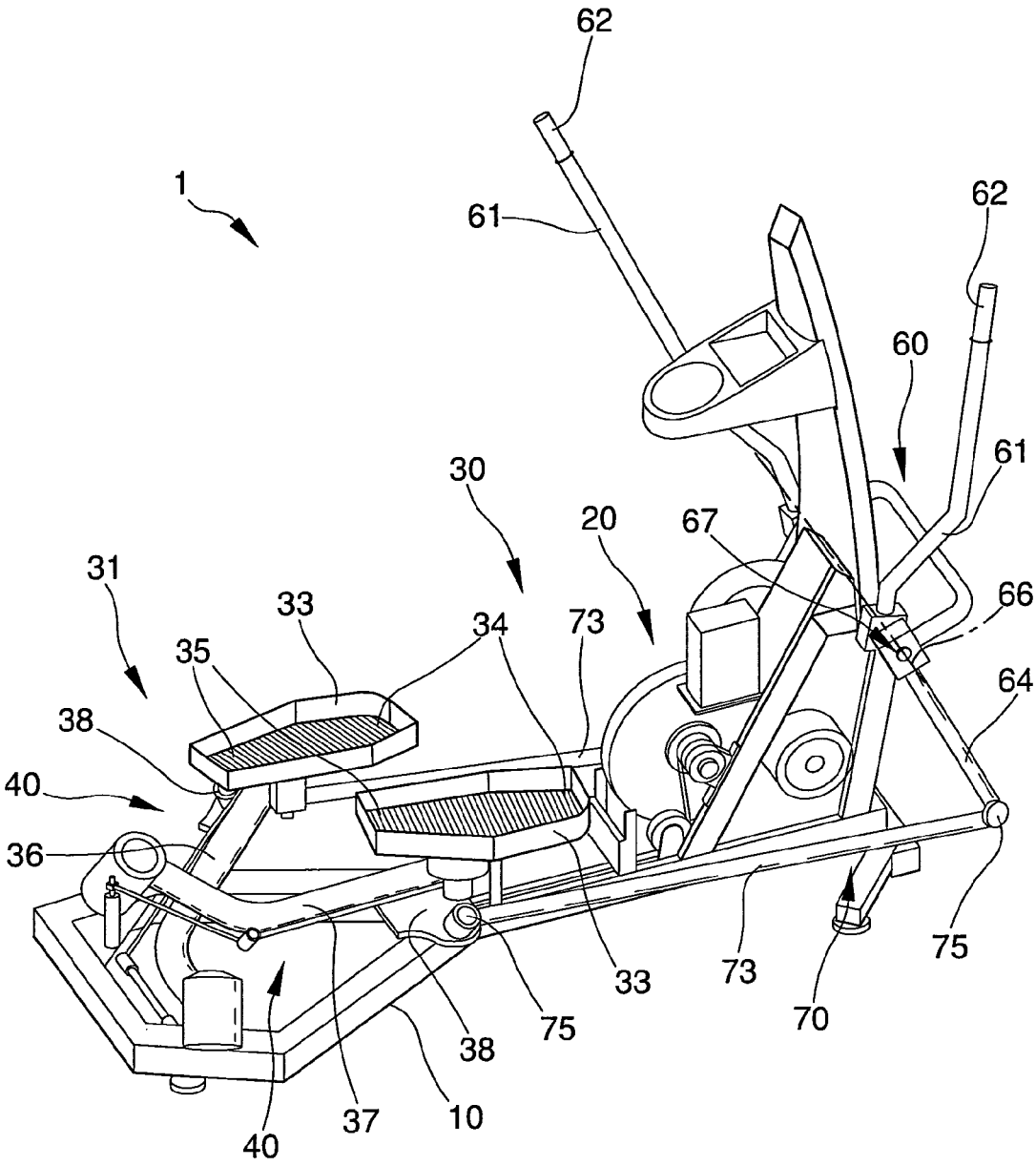
FIG. 1 is a schematic perspective top view of a first preferred embodiment of a gymnastic machine according to the present invention.

In FIG. 1, number 1 indicates, in its entirety, a gymnastic machine for cardiovascular training, designed in such a way as to allow simulation of the skating movement. In this regard, the machine 1 comprises a frame 10 carrying at the front in FIG. 1 a load unit 20 and comprising, at the rear in the same figure, an exercise station 30 suitable for performing a training exercise of the "total body" type, which requires both movement of the lower limbs and movement of the upper limbs. The machine 1 comprises, in the exercise station 30, a first functional group 31 mechanically connected to the load unit 20 in order to exchange mechanical energy with this latter. The group 31 comprises a pair of footrests 33, each of which is carried in a rotatable manner and in open chain by the frame 10 along a given curvilinear trajectory by means of at least one first and one second levers 36 and 37. These levers 36 and 37 are pivoted to the frame 10 on axes inclined with respect to the vertical and in a substantially symmetrical manner. The machine 1 further comprises a control device 40 for controlling the rotation of each footrest 33; this device is suitable to constrain the corresponding footrest 33 with respect to this corresponding first/second lever 36/37 along the given trajectory according to a substantially circular composite movement. Each footrest 33 is movable along the trajectory P according to a substantially curvilinear composite movement that is the result of the combination of an inward inclination movement of the footrest 33, in order to reduce the varus deformity of the knee and favor stability of the ankle of a user, and a forward rotation of the footrest 33, with a lowering of a front portion 34 of the footrest 33 simultaneously to a raising of a rear portion 35 of the footrest 33, in order to stabilize the centre of gravity of a training user.

Furthermore, the exercise station 30 comprises a second functional group 60 provided with a pair of levers 61, each of which is pivoted at the front to the frame 10 in correspondence of a substantially horizontal common axis 66 by means of a cylindrical pair 67 and, as shall become more readily apparent from the description below, is associated with a respective footrest 33. Each lever 61 presents at least a handgrip 62 positioned on the upper part in FIG. 1 and a respective free first end 64 positioned at the opposite side to the corresponding handgrip 62; therefore, each first end 64 is carried movable with oscillating movement by the frame 10 in a plane substantially parallel to the plane M with respect to the axis 66.

The machine 1 further comprises a transmission device 70 suitable to determine the mechanical connection of each handgrip 62 with the respective footrest 33, and therefore with the same load unit 20, for performing an exercise for training the upper limbs in combination with an exercise for training the lower limbs actuatable through simulation of the skating movement.

Figure 3:
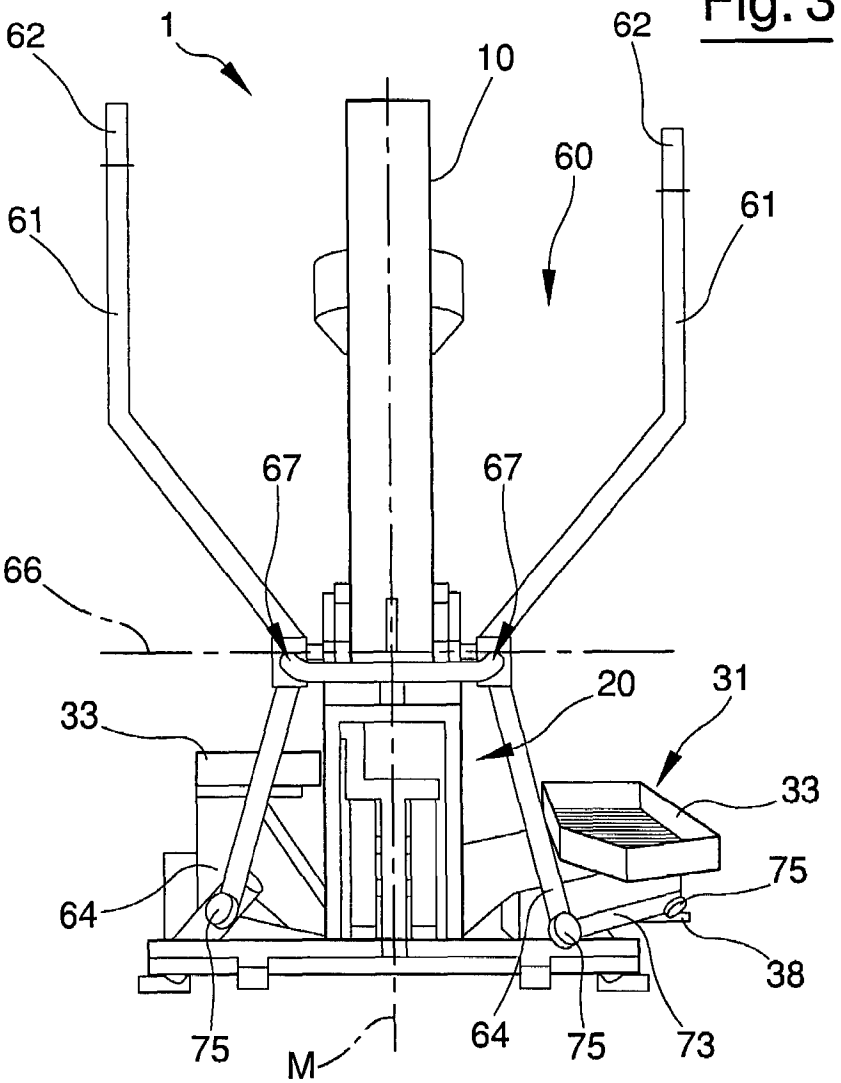
FIG. 3 is a front view of an alternative version to the one in FIG. 2.
Figure 2:
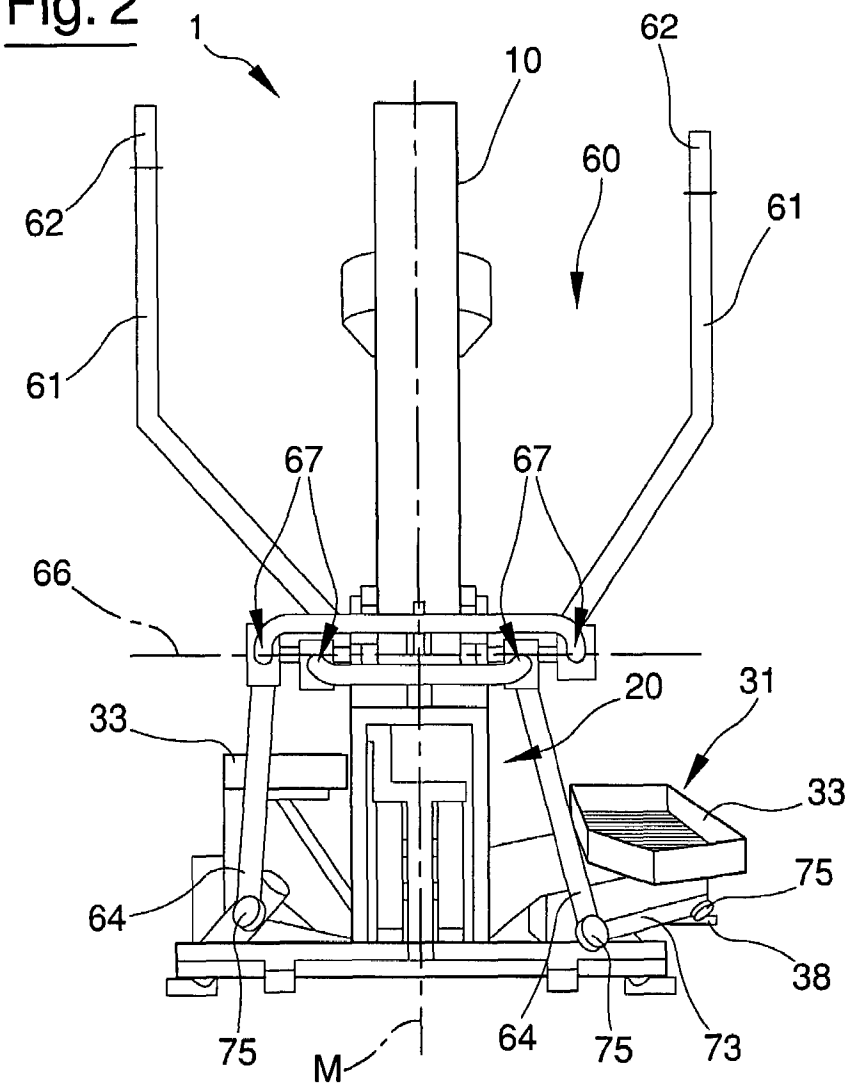
FIG. 2 is a front view of FIG. 1.

The transmission device 70 comprises a lever 73 for connecting each side of the machine 1 with respect to the longitudinal median plane M, and each lever 73 is substantially rectilinear and positioned between the corresponding footrest 33 and the lever 61 in order to constrain these latter to be operatable in phase with respect to the frame 10. This means that, in use, when a user actuates a footrest 33 along the descending path, the corresponding lever 61, positioned at the same side with respect to the median plane M, as shown in FIG. 3, or positioned at the opposite side, as shown in FIG. 1, presents its handgrip 62 movable/operatable forward. The levers 61 can be shaped in a substantially rectilinear manner, as shown in FIG. 3, so that each is connected with a footrest 33 positioned at the same side with respect to the median plane M by means of a lever 73 to maintain a foot and a hand of the same part of the body of a user constantly in phase with each other. Otherwise, each lever 73 can be substantially "S"-shaped, as shown in FIG. 2, so that each lever 61 is connected with a footrest 33 positioned at the opposite side with respect to the median plane M. This allows a foot and a hand of the same part of the body to be maintained constantly in phase opposition with each other, i.e. when a leg pushes a footrest 33 backward, the arm positioned at the same side of the body pulls the corresponding lever 61 backward. Otherwise, in the version of the machine 1 shown in FIG. 3, when, in use, a leg pushes the respective footrest 33 backward, the lever 61 positioned at the same side of the plane M must be pushed forward, or in any case it oscillates forward with the respective handgrip 62, phasing the thrust phases of the right or, respectively, left leg and arm. In any case, the two levers 61 are coupled coaxially to each other to the frame 10.

The connection between each footrest 33 and the respective lever 73 is mediated by the respective lever 36/37, to which the lever 73 is effectively coupled, as shall become more readily apparent from the description below, in correspondence of a bracket 38. In this regard, as shown in FIG. 1, each lever 73 is delimited in correspondence of respective ends by spherically articulated end portions 75. This solution allows stable mechanical coupling of the respective first end 64 of the corresponding lever 61 movable along an arc of circumference to the respective lever 36/37 movable along the given curvilinear trajectory which develops along three directions in space.

Each lever 73 can present longitudinal extension which is telescopically adjustable and can be fixed on a given length, for example by means of a transverse dowel, known and therefore not shown, so as to allow regulation as desired of the starting position of the first ends 64, and therefore of the position of the limits of the oscillating movement of each handgrip 62. This allows different muscle regions of the upper limbs to be recruited according to the needs of the user.

In view of the above description, operation of the machine 1 described above is completely understood and requires no further explanations. However, it may be advisable to specify that by means of the machine 1, and in particular by means of the connection between the first and the second functional group 31 and 60 provided through the transmission device 70, it is possible to perform training of the "total body" type using only one load unit, i.e. the unit 20, and therefore with very limited modifications to any skating simulator.

Finally, it is apparent that modifications and variants can be made to the gymnastic machine 1 described and illustrated herein without however departing from the protective scope of the present invention.

Figure 4:
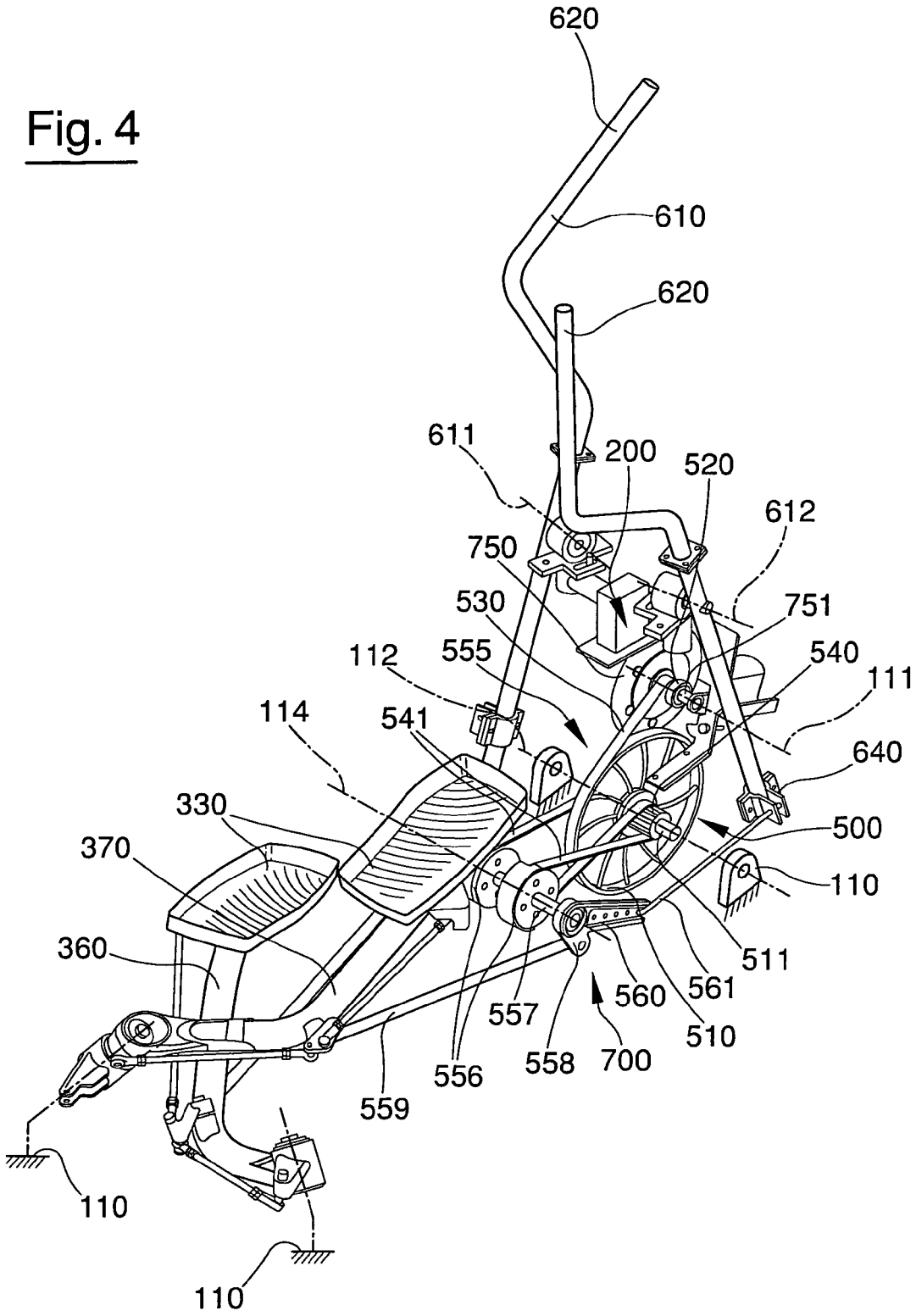
FIG. 4 is a second preferred embodiment of FIG. 1 with parts removed for sake of clarity.

For example, with particular reference to FIG. 4, a modified version of the machine 1 of FIG. 3 is shown, i.e. of the version in which to a backward movement of a footrest 33 there corresponds a forward movement of the handgrip 62 of the lever positioned at the same side of the machine 1 with respect to the plane M. For the sake of convenience, in the following description the machine 1 is indicated with the number 100, and each component already described and illustrated with reference to the machine 1 will be indicated with a reference number which generally will differ from the one previously used by a multiplication factor 10, apart from exceptions made for the sake of clarity of the present invention. The machine 100 presents the respective first functional group 310 and the second functional group 600 connected to each other by means of a transmission device 700, better described hereafter.

The machine 100 comprises a return mechanism 555 which comprises a shaft 557 pivoted to the frame 110 on an axis 114 and carries, keyed, a pair of wheels 556, better described hereafter. It should be noted that the axis 114, and therefore the shaft 557, is positioned between the pivot axes of the levers 610 and the footrests 330. The mechanism 555 comprises two cranks 558 keyed on the shaft 557 in an end position, each of which is connected to the respective lever 360 or 370 by means of a connecting rod 559. Furthermore, a crank 560 is associated with each crank 558 in an angularly fixed manner; this crank 560 is carried by the shaft 557 and belongs to the transmission device 700. This latter further comprises a pair of further connecting rods 561, each of which is positioned between the corresponding crank 560 and a lever 610 positioned at the same side of the plane M. Each connecting rod 561 is coupled in an articulated manner to a free end of a corresponding crank 560 and to a free end 640 of the corresponding lever 610.

In view of the above description, it is easy to understand that the use of the return mechanism 555 allows the right and the left part of the machine 1 to be connected to each other, and, in particular, to provide this connection in a rigid manner. Furthermore, the presence of the device 700 allows connection of the footrests 330 and the levers 610, and thus allows a reduction in the strain necessary to perform the return path towards the raised position of the footrests 330, which is more onerous for less experienced or trained users, or for users who are not familiar with the skating movement.

With reference to FIG. 4, the machine 100 comprises the load unit 200 positioned at the front between the levers 610 below the pivot axes of the levers 610 themselves, and comprises an electromagnetic brake 750, carried by the frame 110, in a manner that is known and therefore not illustrated, by means of a shaft 751, positioned at the front in correspondence of an axis 111 transverse to the median plane M, and operatable by the footrests 33 by means of a belt transmission 500, which is provided with a driven wheel 510, positioned between the wheels 556 and pivoted to the frame 110 on a axis 112 transverse to the plane M and positioned between the axis 114 and the axis 111. The transmission 500 further comprises a spool 520, coaxial to the brake 750, and a belt 530 which connects the driven wheel 510 and the spool 520 to each other in an angularly fixed manner according to a given velocity ratio. A pair of freewheels 540 is provided on the axis 112, and thus coaxially to the driven wheel 510; these freewheels 540 are carried by the frame 110 in a rotatable manner by means of a shaft 511, and each of them is connected to a respective lever 360 or 370 carrying the footrests 330 by means of the two wheels 556, which therefore define the mechanical interface between the return mechanism 555 and the load unit 200, to which the freewheels 540 belong.

It should be noted that the wheels 556 are connected to the respective freewheel 540 by means of a belt 541, and that the two belts 541 are mechanically coupled to the shaft 511 at opposite sides to the driven wheel 510, in order to transmit twisting movements of the same degree to the shaft 557, even if acting at opposite sides with respect to the driven wheel 510. In this regard, as shown in FIG. 4, the belts 541 are wound about the shaft 557, one belt in ring fashion and the other in the shape of an 8.

It should be noted that the two levers 610 are pivoted to the frame by means of known turning pairs, which constrain the two levers 610 to oscillate on axes 611 and 612 which cross each other at a point positioned at the side of the footrests 330, in such a way that it is possible to act on these levers 610 acting in a convergent manner and following a scheme, according to which the user's hands approach the plane M as the distance from the user's chest increases, and vice versa.

This allows to respect a physiological aptitude and, therefore, to fully exploit the thrust action exercised by the arms and their return towards a rest position. Therefore, the presence in combination of the freewheels 540 and of the return mechanism 555 allows to mechanically decouple the shaft 751 of the brake 750 and the shaft 557 of the cranks 558, and thus to combine the possibility of coupling the right and the left parts of the machine 100 in a rigid manner with the possibility of varying at will the stride width; in this way, it is possible to define the machine 100 as a "variable stride width machine". Moreover, this arrangement allows use of the machine 100 to be made truly intuitive and safe, with the result of increasing the number of prospective users of the machine 1 described above.

Figure 5:
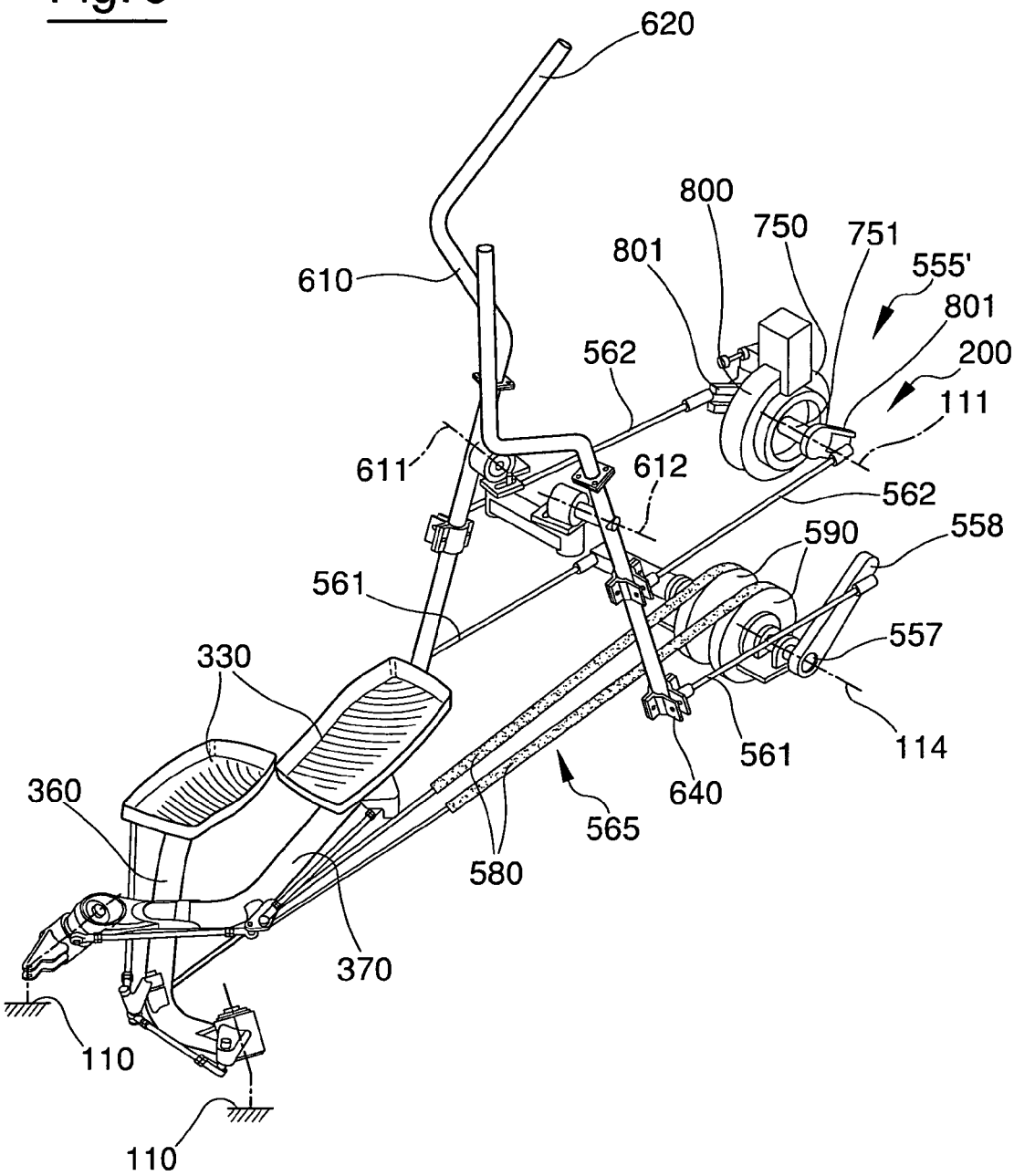
FIG. 5 is a third preferred embodiment of FIG. 1 with parts removed for sake of clarity.

Moreover, the use of the machine 100 can be further facilitated by providing the machine 100 with an accumulator device 800 for accumulating kinetic energy. In FIG. 5 this was obtained by modifying the mechanical arrangement of the machine 100 and inserting this device 800, actuated by means of a flywheel 800, on the axis of the brake 750. In this third version of the machine 1, the connection between the right part and the left part of the machine 100 is provided by means of a return mechanism 555' which comprises, for each lever 360 and 370, a connecting rod 562 which rigidly connects the corresponding lever 610 and the flywheel 800 by means of a crank 801 keyed on the shaft 751, and thus coaxial to the brake 750. As shown in this figure, the shaft 557, and the cranks 558, already present in the version of the machine 100 shown in FIG. 4, are positioned farther forward than the pivot axes 611 and 612 of the levers 610 with respect to the footrests 330. Therefore, the connection between the connecting rods 561 and the free ends 640 of the levers 610 is positioned below the flywheel 800, in front of the pivot axes 611 and 612 of the levers 610, whilst in the previous version, shown in FIG. 4, this connection was positioned at the rear of these axes 611 and 612. Furthermore, the connection between the levers 360 and 370 is completed in FIG. 5 by means of a mechanical connection 565 comprising two rotatable members 590 substantially identical to one another, each of which is keyed on the shaft 557 and coupled to the respective lever 360/370 by means of a belt 580. Naturally, each belt 580 could be replaced at will with a rigid connection obtained by means of connecting rods, known and therefore not shown. It should be noted that each rotatable member 590 can be obtained by means of a cam 590, whose profile can be defined at will, based on the law according to which it is preferable that the resistance to the movement, or the progress of the ascending and descending path of the two footrests 330, evolves during performance of the exercise on the machine 100.

In view of the above description, the mechanical connection of the levers 610 by means of the accumulator device 800 for accumulating kinetic energy positioned on the axis 111 of the brake 750 doubled by the rigid connection between the levers 610 established by the return mechanism 555' allows to achieve the result of mechanically connecting the footrests 330 in a rigid manner and of accumulating motion energy during the descending path of the footrests 330 sufficient to recover energy during motion which helps the user during the ascending phase of the footrests 330.

It should be specified that in FIG. 5 each footrest 330 is connected by means of a belt 580 to a wheel/cam 590 positioned at the opposite side from the median plane M, thus determining an operating condition in which, when a footrest 330 is actuated in its descending path, i.e. backward, the respective handgrip 62 is mobile forward. On the other hand, it is certainly possible to connect a footrest 330 to a wheel/cam 590 positioned at the same or at the opposite side of the plane M by means of a belt 580, based on the need to determine an operating condition in phase or in phase opposition of the footrests 330 and of the levers 610 positioned at the same side of the median plane M.

The invention claimed is:

1. A gymnastic machine for simulating a skating movement, the gymnastic machine comprising:

a frame carrying one load unit; and an exercise station for performing a training exercise, the exercise station including:

a first functional group mechanically connected to the load unit in order to exchange mechanical energy with the load unit, said first functional group including:

two first levers, and two footrests carried symmetrically with respect to a longitudinal median plane, in a rotatable manner and in an open chain by said frame along a given trajectory by the two first levers, with each first lever carrying a respective footrest;

a second functional group positioned in said exercise station and including:

two second levers each provided with a handgrip for each footrest;

transmission means including two third levers each pivoted to said frame and configured to constrain each respective second lever and the respective footrest to operate in phase, with the transmission means being positioned between said first and second functional groups in order to connect each second lever to the respective footrest;

an accumulator member for accumulating kinetic energy; and return means which includes, for each second lever, a first connecting rod which rigidly connects the corresponding said second lever and said accumulator member by means of a first crank, wherein the return means is carried by said frame configured to mechanically connect said two footrests so that a descending movement of one of said footrests corresponds to an ascending movement of the other footrest.

2. A machine according to claim 1, wherein said load unit is positioned at the front between said second levers and comprises an electromagnetic brake, carried by said frame by means of a first shaft operatable by the footrests by means of a transmission; said first crank being rigidly coupled to said first shaft in a coaxial manner to said electromagnetic brake.

3. A machine according to claim 2, provided with return means comprising a second shaft pivoted to the frame and positioned at the opposite side to said footrests with respect to pivot axes of said levers for each said second lever; a second crank rigidly coupled to said second shaft and a second connecting rod positioned at the front of the pivot axes of said second levers in order to connect in an articulated manner a said second lever and the corresponding said second crank.

4. A machine according to claim 3, wherein said return means comprise connecting means provided with at least a rotatable member rigidly coupled to said second shaft and coupled to the respective lever by means of a belt transmission.

5. A machine according to claim 4, wherein said return means comprise connecting means provided with at least a rotatable member rigidly coupled to said second shaft and coupled to the respective first lever by means of a connecting rod transmission.

6. A machine according to claim 5, wherein each said rotatable member comprises a cam to condition the resistance to movement or the progress of the ascending and descending path of the two footrests.

7. A machine according to claim 1, wherein said second levers are shaped in a substantially rectilinear manner in order to be connected to a respective footrest positioned at the same side with respect to said median plane by means of a third lever, in such a way as to maintain a foot and a hand of the same part of the body of a user constantly in phase with each other.

8. A machine according to claim 7, wherein the two third levers are pivoted to said frame in a substantially symmetrical manner and on convergent axes, so that the user's hands approach said median plane as the distance from the user's chest increases, and vice versa.

9. A machine according to claim 1, wherein said second levers are substantially "S"-shaped in order to be connected to a respective footrest positioned at the opposite side with respect to said median plane, in such a way as to maintain a foot and a hand of the same part of the body of a user constantly in phase opposition with each other.

10. A machine according to claim 9, wherein the two third levers are pivoted to said frame in a substantially symmetrical manner and on convergent axes, so that the user's hands approach said median plane as the distance from the user's chest increases, and vice versa.

11. A machine according to claim 7, wherein said second levers are coupled to said frame in correspondence with a common pivot axis by means of respective cylindrical pairs; and wherein each said second lever presents a respective free first end positioned at the opposite side to the respective handgrip and movable with an oscillating movement in a plane that is substantially parallel to said longitudinal median plane with respect to said axis.

12. A machine according to claim 11, wherein each said third lever is delimited by respective end portions spherically articulated to mechanically couple the respective free first end of the corresponding said second lever, movable along a substantially circular trajectory, and a respective first lever of the corresponding said footrest, movable along a three-dimensional trajectory.

13. A machine according to claim 12, wherein each said third lever presents an adjustable longitudinal extension, to make the starting position of said first ends and the position of the limits of the oscillating movement of each handgrip adjustable as desired, to recruit different muscle regions of the upper limbs on the basis of the needs of the user.

14. A machine according to claim 1, further comprising:

control means for controlling the rotation of said respective footrest with respect to said respective first lever in order to constrain the corresponding respective footrest along said trajectory according to a substantially circular composite movement; and wherein each said footrest is carried by each respective first lever.

15. A machine according to claim 14, wherein said composite movement is the result of the combination of an inward inclination movement of the respective footrest, in order to reduce a varus deformity of the knee and to favor stability of the ankle, with a forward rotation of the respective footrest, with a lowering of a front portion of the respective footrest simultaneously to a raising of a rear portion of the respective footrest, in order to stabilize the center of gravity of a training user.

16. A gymnastic machine for simulating a skating movement, the gymnastic machine comprising:

a frame carrying one load unit; and an exercise station for performing a training exercise, the exercise station including:

a first functional group mechanically connected to the load unit in order to exchange mechanical energy with the load unit, said first functional group including:

two first levers, and two footrests carried symmetrically with respect to a longitudinal median plane, in a rotatable manner and in an open chain by said frame along a given trajectory by the two first levers, with each first lever carrying a respective footrest;

a second functional group positioned in said exercise station and including:

two second levers each provided with a handgrip for each footrest;

transmission means including two third levers each pivoted to said frame and configured to constrain each respective second lever and the respective footrest to operate in phase with the transmission means being positioned between said first and second functional groups in order to connect each second lever to the respective footrest; and return means carried by said frame and including:

a first shaft carried in a freely rotatable manner by said frame, a pair of first cranks rigidly coupled on said first shaft, and a pair of first connecting rods, with each first connecting rod connecting each first lever to a corresponding said first crank in order to mechanically connect said footrests in a rigid manner, with the return means configured to mechanically connect said two footrests so that a descending movement of one of said footrests corresponds to an ascending movement of the other footrest.

17. A machine according to claim 16, wherein said first shaft is positioned between the pivot axes of each of said second levers and said footrests.

18. A machine according to claim 17, wherein said transmission device comprises a second crank carried by said first shaft for each footrest, and a second connecting rod to connect a respective second lever positioned at the same side with respect to said plane and the corresponding said second crank in an articulated manner.

19. A gymnastic machine for simulating a skating movement, the gymnastic machine comprising:

a frame carrying one load unit; and an exercise station for performing a training exercise, the exercise station including:

a first functional group mechanically connected to the load unit in order to exchange mechanical energy with the load unit, said first functional group two first levers, and two footrests carried symmetrically with respect to a longitudinal median plane, in a rotatable manner and in an open chain by said frame along a given trajectory by the two first levers, with each first lever carrying a respective footrest; and return means carried by said frame configured to mechanically connect said two footrests so that a descending movement of one of said footrests corresponds an ascending movement of the other footrest;

wherein said load unit includes:

a first shaft, a transmission provided with a driven wheel pivoted to the frame for operating the first shaft by the two footrests, an electromagnetic brake carried by said frame with the electromagnetic brake operated by the first shaft, wherein said transmission farther comprising:

a spool coaxial to said electromagnetic brake; and a first belt which connects said drive wheel to said spool in an angularly fixed manner according to a given velocity ratio;

a pair of freewheels carried by said frame in a rotatable manner in order to mechanically connect said return means and said load unit; and a pair of interfaces, with each interface connecting a respective freewheel to a respective first lever, with each interface including:

a second belt, and an interface wheel connected to a respective freewheel by a respective second belt, and in that one of said second belts is mechanically coupled to the respective freewheel in a ring fashion while the other of said second belts is mechanically coupled to the respective freewheel in the shape of a figure eight.

20. A machine according to claim 19 wherein said return means comprise a second shaft carried in a freely rotatable manner by said frame and a pair of first cranks rigidly coupled on said second shaft, and a pair of first connecting rods, each of which connects each first lever to a corresponding said first crank in order to mechanically connect said footrests in a rigid manner.

21. A machine according to claim 20, wherein said freewheels are positioned between said first shaft and said second shaft.

22. A machine according to claim 19 comprising a second functional group positioned in said exercise station and comprising two second levers provided with a handgrip for each footrest; transmission means being positioned between said first and second functional groups in order to connect each second lever to the respective footrest, by means of a respective third lever pivoted to said frame and configured to constrain the respective second lever and the respective footrest to operate in phase;

wherein said load unit is positioned at the front between said second levers below the pivot axes of said second levers.

* * * * *